US009010905B2

(12) United States Patent
Elferink

(10) Patent No.: US 9,010,905 B2
(45) Date of Patent: Apr. 21, 2015

(54) SUCTION DEVICE FOR CLEANING A NOZZLE SURFACE OF A PRINT HEAD

(71) Applicant: Oce-Technologies B.V., Venlo (NL)

(72) Inventor: Maarten J. H. Elferink, Vancouver (CA)

(73) Assignee: Oce-Technologies B.V., Venlo (NL)

( * ) Notice: Subject to any disclaimer, the term of this patent is extended or adjusted under 35 U.S.C. 154(b) by 0 days.

(21) Appl. No.: 14/158,205

(22) Filed: Jan. 17, 2014

(65) Prior Publication Data

US 2014/0132666 A1 May 15, 2014

Related U.S. Application Data

(63) Continuation of application No. PCT/EP2012/062985, filed on Jul. 4, 2012.

(60) Provisional application No. 61/509,387, filed on Jul. 19, 2011.

(30) Foreign Application Priority Data

Jul. 21, 2011 (EP) ..... 11174796

(51) Int. Cl.
*B41J 2/165* (2006.01)

(52) U.S. Cl.
CPC ..... *B41J 2/16523* (2013.01); *B41J 2/16511* (2013.01); *B41J 2/1652* (2013.01); *B41J 2/16532* (2013.01)

(58) Field of Classification Search
CPC ..... B41J 2/16523; B41J 2002/16514
USPC ..... 347/29–30
See application file for complete search history.

(56) References Cited

U.S. PATENT DOCUMENTS

2009/0278884 A1* 11/2009 Harada ..... 347/30
2010/0045732 A1 2/2010 Fujimori et al.
2011/0164087 A1 7/2011 Kim et al.

* cited by examiner

*Primary Examiner* — Jason Uhlenhake
(74) *Attorney, Agent, or Firm* — Birch, Stewart, Kolasch & Birch, LLP

(57) ABSTRACT

A suction device is provided for cleaning a nozzle surface of a print head. The suction device comprises a suction surface and a spacer, whereby the spacer is provided with a spacer channel, the spacer channel comprising a spacer opening at an outer surface of the spacer and the spacer channel being operatively coupled to an air flow source. The spacer is configured for positioning the suction surface at a predetermined distance from the nozzle surface for providing a suction gap. The suction device is configured to provide in operation an air flow through the suction gap, along the nozzle surface and into the suction channel. An air flow may be provided through the spacer channel of the spacer in order to clean an area of the nozzle surface of the print head.

20 Claims, 6 Drawing Sheets

SUCTION DEVICE FOR CLEANING A NOZZLE SURFACE OF A PRINT HEAD

CROSS REFERENCE TO RELATED APPLICATIONS

This non-provisional application is a Continuation of International Application No. PCT/EP2012/062985 filed on Jul. 4, 2012, which claims priority under 35 U.S.C. 119(e) to U.S. Provisional Application No. 61/509,387 filed on Jul. 19, 2011 and under 35 U.S.C. 119(a) to European Patent Application No. 11174796.0 filed in Europe on Jul. 21, 2011, all of which are hereby expressly incorporated by reference into the present application.

FIELD OF THE INVENTION

The present invention relates to a suction device for cleaning a nozzle surface of a print head. The present invention further relates to a method for cleaning a nozzle surface of a print head by using the suction device.

BACKGROUND OF THE INVENTION

A suction device is commonly used for cleaning a nozzle surface of a print head. In case dirt on the nozzle surface of the print head or air bubbles in the ink chambers of the print head inhibits the accurate and reliable jetting of inkjet droplets, the nozzle surface of the print head needs to be cleaned of said dirt or of ink, in case the ink chambers of the print head are purged.

The suction device commonly comprises a suction surface which holds several suction channels, a waste ink buffer to collect sucked ink and a suction air pressure source in order to provide a suction air pressure. Before cleaning the suction surface is positioned near the surface of the nozzle surface at a predetermined height in order to provide a small gap between the nozzle surface and the suction surface. The print head is purged, whereby ink is moved from the ink chambers through the nozzles onto the surface of the nozzle surface.

By providing a suction air pressure through the suction channels in the small gap between the nozzle surface and the suction surface an air flow will be provided. The air flow will force the purged ink towards the suction channels and this flow of ink will also take away dirt from the nozzle surface on its way into the suction device.

It is important that the nozzle surface and the suction surface are accurately aligned in order that the gap between the nozzle surface and the suction surface is accurately controlled over the whole surface of the nozzle surface. This makes sure that the air flow provides an air velocity, which is substantially equal in this gap and that the surface of the nozzle surface may equally be cleaned by the suction device.

A conventional suction device is positioned near to a nozzle surface by using external positioning elements for aligning the nozzle surface and the suction surface and providing a predetermined gap. However the use of an external positioning element increases the cost of the suction device and may introduce errors into the height, the x-rotation and y-rotation between the aligned nozzle surface and the suction surface.

Alternatively a suction device may also be positioned by supporting spacers on the surface of the nozzle surface. A drawback of using spacers which are supported on the nozzle surface is that the area on the surface of the nozzle surface on which the spacers are supported cannot effectively be cleaned by the suction device. As a result dirt and ink which remain on these areas of the nozzle surface may reduce the reliability of jetting inkjet droplets from the print head.

SUMMARY OF THE INVENTION

It is accordingly an object of the present invention to provide a suction device for effectively cleaning the surface of a nozzle surface of a print head, which suction device mitigates the above mentioned drawbacks.

This object is attained by a suction device for cleaning a nozzle surface of a print head, the suction device comprising a) a suction surface, comprising a suction opening operatively coupled to a suction channel;

b) a spacer, wherein the spacer is configured for positioning the suction surface at a predetermined distance from the nozzle surface for providing a suction gap, wherein the spacer is provided with a spacer channel, the spacer channel comprising a spacer opening at an outer surface of the spacer and the spacer channel being operatively coupled to an air flow source; and c) an air flow suction unit, the air flow suction unit being operatively coupled to the suction channel;

the suction device being configured to provide in operation an air flow through the suction gap, along the nozzle surface and into the suction channel.

According to the invention the spacer is provided with a spacer channel, the spacer channel comprising a spacer opening at an outer surface of the spacer and the spacer channel being operatively coupled operatively coupled to an air flow source. The spacer channel and the spacer opening of the channel may be used to provide an air flow through the open spacer. In case the spacer is positioned near the nozzle surface, the nozzle surface may be cleaned by the air flow in the area near to the spacer. In a next step the spacer may be supported on said area of the nozzle surface, which has been cleaned by the air flow through the spacer channel.

The spacer is configured for positioning the suction surface at a predetermined distance from the nozzle surface for providing a suction gap.

In an embodiment the spacer protrudes with respect to the suction surface and the suction device is configured to support the nozzle surface by the outer surface of the spacer. The outer surface of the spacer protrudes with respect to the suction surface. By supporting the nozzle surface by the outer surface of the spacer the suction surface is positioned at the predetermined distance from the nozzle surface and a suction gap is provided.

In a particular embodiment of the suction device, the spacer opening of the spacer is arranged to be closed upon supporting of the spacer on the nozzle surface. This has the advantage that the air flow through the spacer opening is blocked. Furthermore the available air pressure which is provided by the air flow suction unit may fully be used for providing an air flow in the suction gap.

In an embodiment the spacer may be an air bearing means. The air bearing means is configured for blowing an air flow through the spacer channel and the spacer opening towards the nozzle surface thereby positioning the suction surface at the predetermined distance from the nozzle surface for providing the suction gap.

In an embodiment at least two spacers are provided, each spacer comprising a spacer channel, each spacer channel comprising a spacer opening at an outer surface of the respective spacer. The at least two spacers are configured for positioning the suction surface at a predetermined distance from the nozzle surface for providing a suction gap.

In an embodiment the at least two spacers are connected by an element, which element extends substantially parallel to the suction surface and outside of the surface area of the suction surface. This embodiment provides the advantage that the at least two spacers including the connecting element may be provided as one material piece only. The connecting element is arranged far enough from the sides of the suction gap, such that the connecting element will not substantially restrict the air flow provided through the suction gap along the nozzle surface and into the suction channel.

The suction surface comprises a suction opening operatively coupled to a suction channel. The suction device is configured to provide in operation an air flow through the suction gap, along the nozzle surface and into the suction channel. For example the air flow suction unit provides (via the suction channel) a suction air pressure in the suction gap, thereby providing the air flow in the suction gap.

In case ink is present on the nozzle surface, the ink will flow over the surface towards the suction channel and will be sucked into the suction channel. As a result of the air flow in the suction gap along the nozzle surface the nozzle surface may be cleaned. The flowing ink may also pick up and remove dirt from the nozzle surface.

The air flow in the suction gap is suitably selected in order to provide an air velocity in the suction gap which is suitable for cleaning the nozzle surface (e.g. a high air velocity). It is commonly known for the person skilled in the art how to provide an air flow in a suction gap of a suction device. For example by arranging a plurality of suction channels in the suction surface at certain positions, by selecting the diameter of the suction channels, by selecting the height of the suction gap and by providing an air pressure in the suction gap.

Thus the nozzle surface is effectively cleaned by the suction device of the present invention in the supporting area of a spacer on the nozzle surface, by providing an air flow through the spacer channel of each of the spacers, and in the area of the suction surface, by providing an air flow in the suction gap.

The spacer opening of spacer channel of the spacer may comprise a hole, may comprise a gap, may comprise a crevice or may comprise a plurality of holes, gaps and/or crevices. The spacer opening of the spacer channel may be arranged at a top surface of the spacer, such that the spacer opening may be closed upon supporting of the spacer on a flat surface, such as a nozzle surface. The spacer opening may also be arranged at a side surface of the spacer, such that the spacer opening is not closed or not fully closed upon supporting of the spacer on a flat surface, such as a nozzle surface.

In an embodiment of the suction device, the spacer channel of the spacer is operatively coupled to the suction channel. In this way a connection of the spacer to the suction surface and a connection of the spacer channel of the spacer to an air flow source can be simple and cheap.

In an embodiment of the suction device, the air flow source being coupled to the spacer channel is the air flow suction unit, which is also operatively coupled to the suction channel. In this embodiment the air flow suction unit may be used both to provide the air flow through the spacer channel and to provide an air flow in the suction gap.

In an embodiment of the suction device, the suction device comprises a plurality of suction channels being arranged in a row. This has the advantage that the high air flow may be well controlled along the row of plurality of suction channels.

In a further embodiment of the suction device, the row of suction channels has a length being substantially equal to a length of a row of nozzles of the nozzle surface. This has the advantage that no movement of the suction gap along the length of the row of nozzles of the nozzle surface is needed to clean the nozzle surface around the nozzles and it will limit the amount of dirt dragged along the nozzle surface.

In a further embodiment of the suction device, wherein a first spacer is positioned adjacent to a first end of the row of suction channels and a second spacer is positioned adjacent to a second end of the row of suction channels and wherein the spacer opening of each spacer is configured to be arranged opposite to the nozzle surface in an area outside of a nozzle area. This arrangement of the spacers enables a simple and effective alignment of the suction surface to the nozzle surface. In an example, in case the spacer protrudes from the suction surface, each spacer is supported on the nozzle surface in an area outside of a nozzle area.

In an embodiment of the suction device, the plurality of suction channels is arranged at a distance between each other being substantially equal to a width of the nozzle surface. This arrangement provides that the restriction from each suction channel towards the environment is substantially equal and therefore provides that the nozzle surface is equally cleaned by the air flow.

In an embodiment of the suction device, the suction device further comprises a waste tray being operatively coupled to the suction channel and being operatively coupled to the air flow suction unit. By providing a negative air pressure in the waste tray, which waste tray also may act as a buffer for the suction air pressure, each operatively coupled suction channel may equally be supplied by the suction air pressure in the waste tray. Preferably the waste tray is sealed during operation of the air flow suction unit.

In an embodiment of the suction device, the suction device further comprises a flexure element, which flexure element is configured to provide lower stiffness to the suction device in at least one of the directions of z-direction, x-rotation and y-rotation relative to a stiffness of the flexure element in the x-direction and the y-direction. The flexibility of the flexure element provides that the spacers may accurately align the suction surface parallel to the surface of the nozzle surface of the print head in mentioned directions.

In another aspect of the invention a method for cleaning a nozzle surface of a print head is provided, the nozzle surface comprising a plurality of nozzles, by using a suction device, the suction device comprising:

- a suction surface, which comprises a suction opening operatively coupled to a suction channel;
- a spacer, wherein the spacer is configured for positioning the suction surface at a predetermined distance from the nozzle surface, wherein the spacer is provided with a spacer channel, the spacer channel comprising a spacer opening at an outer surface of the spacer and the spacer channel being operatively coupled to an air flow source; and
- an air flow suction unit, the air flow suction unit being operatively coupled to the suction channel; the method comprising the steps of:

a) positioning the spacer near the nozzle surface and away from a nozzle;

b) providing an air flow through the spacer channel of the spacer;

c) the spacer positioning the suction surface at the predetermined distance from the nozzle surface, thereby providing a suction gap; and d) providing an air flow through the suction gap, along the nozzle surface and into the suction channel in order to clean the nozzle surface.

In step a) the spacer is positioned near the nozzle surface and away from a nozzle. The spacer channel may be used to provide an air flow through the spacer. In step b) an air flow is provided through the spacer channel of the spacer. Step b) may be carried out after step a). Alternatively step a) may be carried out during step b).

In an embodiment of the method the spacer protrudes with respect to the suction surface and wherein step c) comprises supporting the outer surface of the spacer on the surface of the nozzle surface in order to position the suction surface at the predetermined distance from the nozzle surface.

In an embodiment of the method step b) comprises cleaning an area of the nozzle surface using the air flow and wherein in step c) the spacer is supported on the area of the nozzle surface, which has been cleaned during step b).

During step b) the area of the nozzle surface which is opposite to the spacer opening may be cleaned by the air flow.

In a particular embodiment of the method step b) comprises sucking air through the spacer channel of the positioned spacer in order to clean the area of the nozzle surface. For example the air flow suction unit may be used to provide a suction pressure in the spacer channel of the spacer thereby sucking air through the spacer channel.

In another particular embodiment of the method step b) comprises blowing air through the spacer channel of the positioned spacer in order to clean the area of the nozzle surface.

In an embodiment of the method in step c) the spacer opening of the spacer channel of the supported spacer is closed by the nozzle surface. In this way the air flow through the spacer opening is blocked. Furthermore the available air pressure which is provided by the air flow suction unit may fully be used for providing an air flow in the suction gap.

In an embodiment of the method step b) and step c) are performed at the same time and step c) comprises blowing air through the spacer channel of the spacer in order to arrange the suction surface at the predetermined distance from the nozzle surface. In this embodiment the spacer comprises an air bearing means.

In case the spacer is an air bearing means, an air flow is provided through the spacer channel and the spacer opening towards the nozzle surface. The air bearing means is configured for, during step c), blowing an air flow through the spacer channel and the spacer opening towards the nozzle surface thereby positioning the suction surface at the predetermined distance from the nozzle surface.

While the nozzle surface is being moved closer towards the suction surface of the suction device, the distance between the spacer opening of the spacer and the nozzle surface is becoming smaller and the air flow through the spacer channel of the spacer will flow over the area of the nozzle surface close to the spacer opening. Furthermore the velocity of the air flow close to the nozzle surface will increase in case the distance between the spacer opening and the nozzle surface becomes smaller. As the distance reaches the predetermined distance, a suitably selected air pressure develops in the suction gap near the spacer opening, such that the distance between the suction gap and the nozzle surface is maintained accurately.

Both step a) and step c) may be provided by a relative movement of the print head and the suction device with respect to each other, for example in z-direction, being a height direction perpendicular to a direction (x and y-direction) of the nozzle surface.

In step d) an air flow is provided through the suction gap, along the nozzle surface and into the suction channel in order to clean the nozzle surface. In an example ink is available on the nozzle surface during step d). This has the advantage that the ink will flow over the nozzle surface towards the suction channel and may pick up dirt which is located on the nozzle surface. The ink may be provided on the nozzle surface in any way, for example also by misting behavior of ink droplets ejected from the print head.

In an embodiment of the method, the method further comprises step e) purging the print head, thereby moving ink through at least one of the plurality of nozzles onto the nozzle surface. This step has the advantage that a controlled amount of ink may be moved onto the nozzle surface. Furthermore by purging the print head, air bubbles and dirt present in the ink chambers of the print head may be removed from the ink chambers of the print head.

Step e) purging the print head may be carried out after step b) and may be carried out before step b).

Furthermore Step e) purging the print head may be carried out before step d) and may be carried out during step d) providing an air flow through the suction gap. Preferably step e) is carried out during d). This has the advantage that the air flow may be accurately controlled in the suction gap, while the ink is moved onto the nozzle surface.

In another aspect of the invention an inkjet printer is provided comprising the suction device of the present invention.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

Hereinafter, the present invention is further elucidated with reference to the appended drawings showing non-limited embodiments and wherein.

DETAILED DESCRIPTION

Figure 1A:
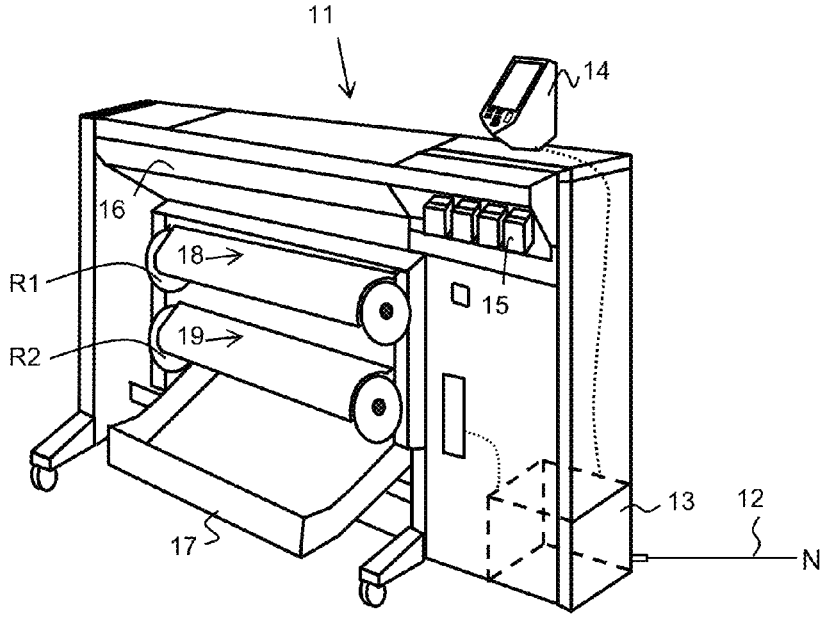
FIG. 1A shows a perspective view of a wide format inkjet printing device.

The present invention will now be described with reference to the accompanying drawings, wherein the same reference numerals have been used to identify the same or similar elements throughout the several views.

Figure 1B:
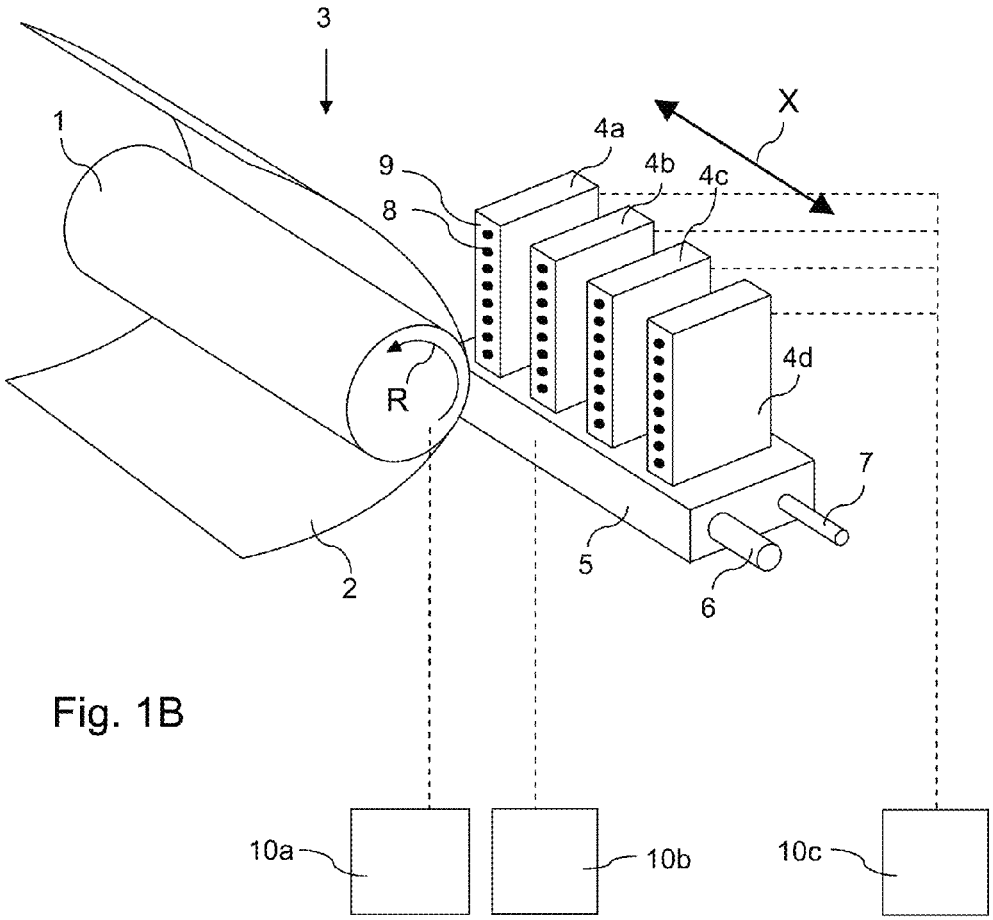
FIG. 1B shows an ink jet printing assembly.

FIG. 1A shows an image forming apparatus 11, wherein printing is achieved using a wide format inkjet printer. The wide-format image forming apparatus 11 comprises a housing 16, wherein the printing assembly, for example the ink jet printing assembly shown in FIG. 1B is placed. The image forming apparatus 11 also comprises a storage means for storing image receiving member 18, 19, a delivery station to collect the image receiving member 18, 19 after printing and storage means for marking material 15. In FIG. 1A, the delivery station is embodied as a delivery tray 17. Optionally, the delivery station may comprise processing means for processing the image receiving member 18, 19 after printing, e.g. a folder or a puncher. The wide-format image forming apparatus 11 furthermore comprises means for receiving print jobs and optionally means for manipulating print jobs. These means may include a user interface unit 14 and/or a control unit 13, for example a computer.

Images are printed on an image receiving member, for example paper, supplied by a roll 18, 19. The roll 18 is supported on the roll support R1, while the roll 19 is supported on the roll support R2. Alternatively, cut sheet image receiving members may be used instead of rolls 18, 19 of image receiving member. Printed sheets of the image receiving member, cut off from the roll 18, 19, are deposited in the delivery tray 17.

Each one of the marking materials for use in the printing assembly are stored in four containers 15 arranged in fluid connection with the respective print heads for supplying marking material to said print heads.

The local user interface unit 14 is integrated to the print engine and may comprise a display unit and a control panel. Alternatively, the control panel may be integrated in the display unit, for example in the form of a touch-screen control panel. The local user interface unit 14 is connected to a control unit 13 placed inside the printing apparatus 36. The control unit 13, for example a computer, comprises a processor adapted to issue commands to the print engine, for example for controlling the print process. The image forming apparatus 11 may optionally be connected to a network N. The connection to the network N is diagrammatically shown in the form of a cable 12, but nevertheless, the connection could be wireless. The image forming apparatus 11 may receive printing jobs via the network. Further, optionally, the controller of the printer may be provided with a USB port, so printing jobs may be sent to the printer via this USB port.

FIG. 1B shows an ink jet printing assembly 3. The ink jet printing assembly 3 comprises supporting means for supporting an image receiving member 2. The supporting means are shown in FIG. 1B as a platen 1, but alternatively, the supporting means may be a flat surface. The platen 1, as depicted in FIG. 1B, is a rotatable drum, which is rotatable about its axis as indicated by arrow R. The supporting means may be optionally provided with suction holes for holding the image receiving member in a fixed position with respect to the supporting means. The ink jet printing assembly 3 comprises print heads 4*a*-4*d*, mounted on a scanning print carriage 5. The scanning print carriage 5 is guided by suitable guiding means 6, 7 to move in reciprocation in the main scanning direction B. Each print head 4*a*-4*d* comprises a nozzle surface 9, which nozzle surface 9 is provided with at least one nozzle 8. The print heads 4*a*-4*d* are configured to eject droplets of marking material onto the image receiving member 2. The platen 1, the carriage 5 and the print heads 4*a*-4*d* are controlled by suitable controlling means 10*a*, 10*b* and 10*c*, respectively.

The image receiving member 2 may be a medium in web or in sheet form and may be composed of e.g. paper, cardboard, label stock, coated paper, plastic or textile. Alternatively, the image receiving member 2 may also be an intermediate member, endless or not. Examples of endless members, which may be moved cyclically, are a belt or a drum. The image receiving member 2 is moved in the sub-scanning direction R by the platen 1 along four print heads 4*a*-4*d* provided with a fluid marking material.

A scanning print carriage 5 carries the four print heads 4*a*-4*d* and may be moved in reciprocation in the main scanning direction X parallel to the platen 1, such as to enable scanning of the image receiving member 2 in the main scanning direction X. Only four print heads 4*a*-4*d* are depicted for demonstrating the invention. In practice an arbitrary number of print heads may be employed. In any case, at least one print head 4*a*-4*d* per color of marking material is placed on the scanning print carriage 5. For example, for a black-and-white printer, at least one print head 4*a*-4*d*, usually containing black marking material is present. Alternatively, a black-and-white printer may comprise a white marking material, which is to be applied on a black image-receiving member 2. For a full-color printer, containing multiple colors, at least one print head 4*a*-4*d* for each of the colors, usually black, cyan, magenta and yellow is present. Often, in a full-color printer, black marking material is used more frequently in comparison to differently colored marking material. Therefore, more print heads 4*a*-4*d* containing black marking material may be provided on the scanning print carriage 5 compared to print heads 4*a*-4*d* containing marking material in any of the other colors. Alternatively, the print head 4*a*-4*d* containing black marking material may be larger than any of the print heads 4*a*-4*d*, containing a differently colored marking material.

The carriage 5 is guided by guiding means 6, 7. These guiding means 6, 7 may be rods as depicted in FIG. 1B. The rods may be driven by suitable driving means (not shown). Alternatively, the carriage 5 may be guided by other guiding means, such as an arm being able to move the carriage 5. Another alternative is to move the image receiving material 2 in the main scanning direction X.

Each print head 4*a*-4*d* comprises a nozzle surface 9 having at least one nozzle 8, in fluid communication with a pressure chamber containing fluid marking material provided in the print head 4*a*-4*d*. On the nozzle surface 9, a number of nozzles 8 are arranged in a single linear array parallel to the sub-scanning direction A. Eight nozzles 8 per print head 4*a*-4*d* are depicted in FIG. 1B, however obviously in a practical embodiment several hundreds of nozzles 8 may be provided per print head 4*a*-4*d*, optionally arranged in multiple arrays. As depicted in FIG. 1B, the respective print heads 4*a*-4*d* are placed parallel to each other such that corresponding nozzles 8 of the respective print heads 4*a*-4*d* are positioned in-line in the main scanning direction X. This means that a line of image dots in the main scanning direction X may be formed by selectively activating up to four nozzles 8, each of them being part of a different print head 4*a*-4*d*. This parallel positioning of the print heads 4*a*-4*d* with corresponding in-line placement of the nozzles 8 is advantageous to increase productivity and/or improve print quality. Alternatively multiple print heads 4*a*-4*d* may be placed on the print carriage adjacent to each other such that the nozzles 8 of the respective print heads 4*a*-4*d* are positioned in a staggered configuration instead of in-line. For instance, this may be done to increase the print resolution or to enlarge the effective print area, which may be addressed in a single scan in the main scanning direction. The image dots are formed by ejecting droplets of marking material from the orifices 8.

Upon ejection of the marking material, some marking material may be spilled and stay on the nozzle surface 9 of the print head 4*a*-4*d*. The ink present on the nozzle surface 9 may negatively influence the ejection of droplets and the placement of these droplets on the image receiving member 2. Therefore, it may be advantageous to remove excess of ink from the nozzle surface 9.

Figure 2A:
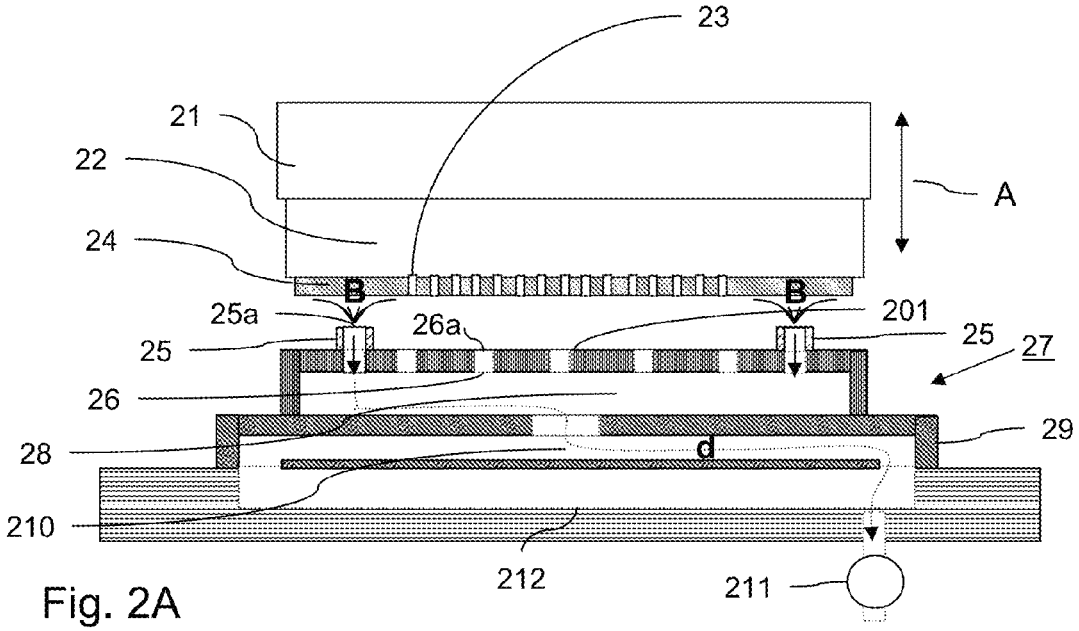
FIGS. 2A and 2B show a first embodiment of a suction device according to the invention.
Figure 2B:
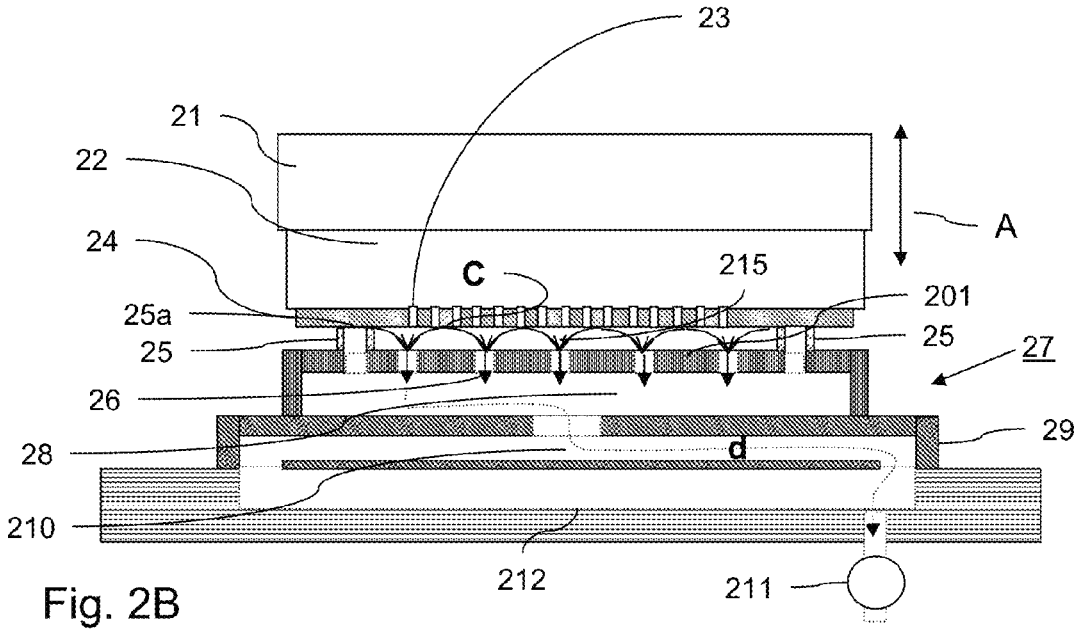

FIGS. 2A and 2B show a suction device according to the first embodiment of the present invention. Suction device 27 is positioned close to print head 22. Print head 22 comprises nozzle surface 24, which comprises a plurality of nozzles 23. Each nozzle is connected to a print head ink chamber (not shown). The print head 22 is mounted on carriage 21. The print head 22 and the carriage 21 may be moved in z-direction (indicated by arrow A), which is perpendicular to a direction (x and y-direction) of the nozzle surface 24.

Suction device 27 comprises a suction surface 201, which comprises a plurality of suction openings 26*a*, each being operatively coupled to a suction channel 26, which suction openings 26*a* are arranged in a row. Two spacers 25 are arranged on top of one of the suction channels at both ends of the row of suction channels. Each spacer 25 comprises a spacer opening 25*a*, which is operatively coupled to a spacer channel 25*b* being operatively coupled to the suction channel beneath the hole. The two spacers are sized to position the suction surface 201 at a predetermined height above the nozzle surface.

The suction device 27 further comprises a flexure element 29, which flexure element 29 is configured to provide low stiffness to the suction device (i.e. be compliant) in the directions of z-direction, x-rotation and y-rotation. The low stiffness of the flexure element in those three directions assures that during supporting of the spacers on the nozzle surface 24, the spacers 25 accurately align the suction surface parallel to the nozzle surface 24 of the print head 22. As a result of the accurate alignment the suction gap is at a substantially equal height over the nozzle surface.

The suction device 27 further comprises an air flow suction unit 211, a vacuum buffer 28 being operatively coupled to the suction channels, and sized to provide a buffer for the suction air pressure, a channel structure 210 in connection to the buffer 28, a waste tray 212, being operatively coupled to the channel structure 210 and to the air flow suction unit 211.

FIG. 2A shows the suction device 27 in case the spacers 25 are positioned near the surface of the nozzle surface 24 in an area away from a nozzle. In FIG. 2A an air flow is shown by arrows B through the spacer opening (or hole) of the spacers 25. The air flow also flows over an area of the nozzle surface 24 away from a nozzle and thereby cleans that area of the nozzle surface 24. Any remaining ink and dirt may be picked up by the air flow and be removed from the nozzle surface 24 in that area.

As an example the flow of air inside the suction device 27 through the suction buffer 28 and channel structure 210 towards the air flow suction unit 211 is indicated by arrow d.

FIG. 2B shows the suction device in a next step, wherein the spacers 25 are supported on the nozzle surface 24. The spacer openings 25*a* of the spacers 25 are closed by the nozzle surface 24 and no air can flow through the holes 25*a* of the spacers 25. The suction surface 201 is positioned by the spacers 25 at a predetermined height above the nozzle surface 24 to be cleaned and a suction gap 215 is formed.

A suction air pressure is provided in the suction gap 215 by air flow suction unit 211 via waste tray 212, channel structure 210, buffer 28 and suction channels 26. The suction air pressure in the suction gap 215 provides a high air flow C in the suction gap 215 close to the nozzle surface 24 in a direction parallel to the nozzle surface 24. The open spacers 25 do not restrict the high air flow coming from the sides of the suction gap 215. The high air flow C in the suction gap 215 is in the direction of the suction channels 26. By purging the print head 22 ink is moved through the nozzles 23 onto the nozzle surface 24 in the suction gap 215. The ink on the surface of the nozzle surface 24 will be taken by the air flow towards the suction channels 26. The ink flow may pick up any dirt on the surface of the nozzle surface 24. As such the surface of the nozzle surface 24 is cleaned from ink and dirt.

As an example the flow of air inside the suction device 27 through the vacuum buffer 28 and channel structure 210 towards the air flow suction unit 211 is indicated by arrow d.

Figure 3:
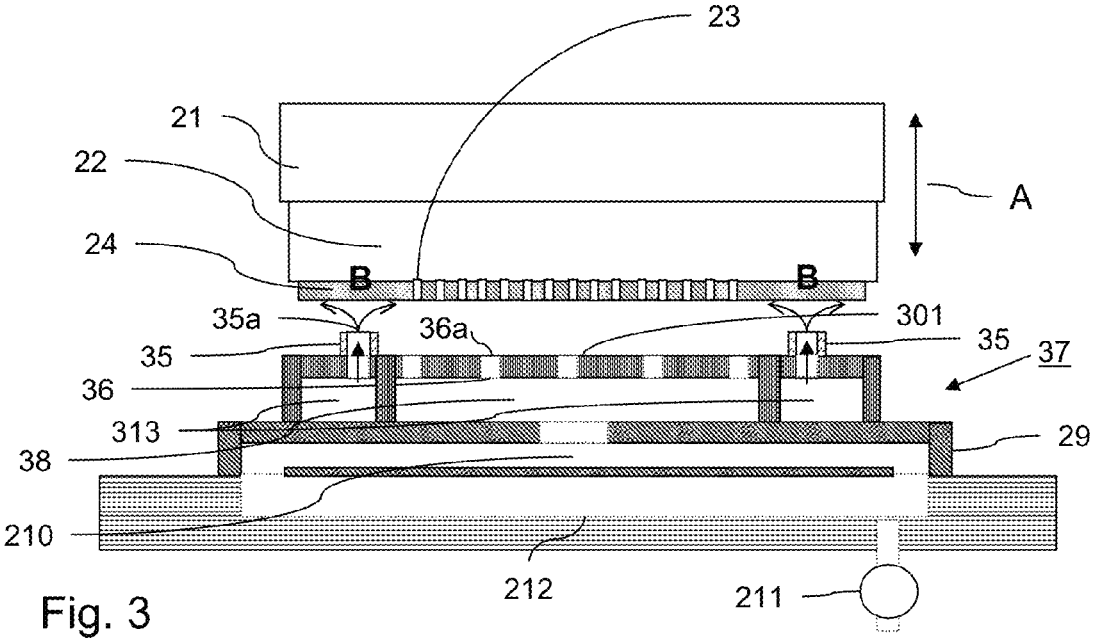
FIG. 3 shows a second embodiment of a suction device according to the invention.

FIG. 3 shows a suction device according to the second embodiment of the present invention. Suction device 37 is positioned close to print head 22.

Suction device 37 comprises a suction surface 301, which comprises a plurality of suction openings 36*a* operatively coupled to suction channels 36, which are arranged in a row. Two spacers 35 are arranged near both ends of the row of suction channels 36. Each spacer 35 comprises a spacer opening 35*a*, which is operatively coupled to an air flow chamber 313 beneath the spacer opening. The two spacers are sized to position the suction surface 301 at a predetermined height above the nozzle surface to be cleaned. The air flow chambers 313 are operatively coupled to an external air flow source (not shown). The buffer 38, which is operatively coupled to the suction channels 26, is slightly smaller. The other parts of the suction device 37 are similar to the parts of the suction device 27.

FIG. 3 shows the suction device 37 in case the spacers 35 are positioned near the nozzle surface 24 in an area away from a nozzle. The air flow source provides an air flow through the spacer openings 35*a* of each spacer 35 by providing a positive air pressure in chamber 313. In FIG. 3 the air flow is shown by arrows B through the spacer opening (or hole) of the spacers 35. The air flow also flows over an area of the nozzle surface 24 away from a nozzle and thereby cleans that area of the nozzle surface 24. Any remaining ink and dirt may be picked up by the air flow and be removed from the nozzle surface 24 in that area.

Any ink or dirt that is moved by the air flow B towards another part of the nozzle surface 24 may be removed from the nozzle surface in a following cleaning procedure wherein the spacers 35 are supported on the surface of the nozzle surface 24, the print head 22 is purged such that ink is moved onto the surface of the nozzle surface 24 and at the same time a high air flow is provided in the suction gap towards the suction channels 26.

FIG. 4A-4E shows five exemplary embodiments of spacers according to the invention.

Figure 4A:
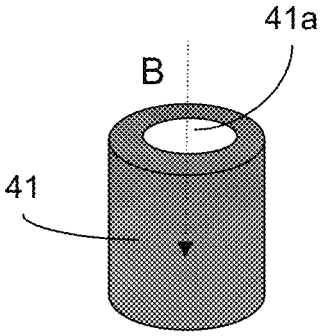
FIG. 4A-4E shows five embodiments of spacers according to the invention.

FIG. 4A shows a spacer 41, which has a pipe form, having a circular spacer opening 41*a* in connection with an air flow source and being open at the top of the spacer 41. Air may flow through the spacer opening 41*a* in direction of arrow B or in opposite direction. In case the spacer 41 is supported on a flat surface, the spacer opening 41*a* is closed at the top surface of the spacer and the air flow through spacer opening 41*a* will be blocked.

Figure 4B:
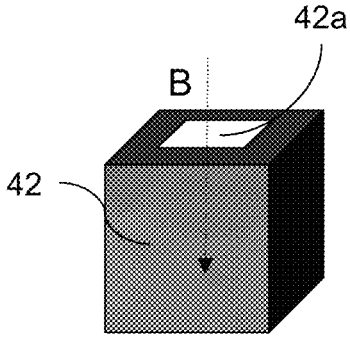

FIG. 4B shows a spacer 42, which has a rectangular form, having a square spacer opening 42*a* in connection with an air flow source and being open at the top surface of the spacer 42. Air may flow through the spacer opening 42*a* in direction of arrow B or in opposite direction. In case the spacer 42 is supported on a flat surface, the spacer opening 42*a* is closed at the top surface of the spacer and the air flow through spacer opening 42*a* will be blocked.

Figure 4C:
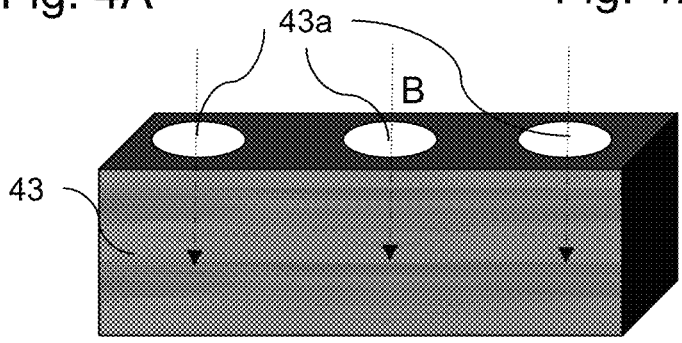

FIG. 4C shows a spacer 43, which has a rectangular form, having three circular spacer openings 43*a* in connection with an air flow source and being open at the top surface of the spacer 43. The three spacer openings 43*a* are arranged such that the air flow (arrow B) through the spacer openings 43*a* may flow over a flat surface near the spacer 43. In case the spacer 43 is supported on a flat surface, the spacer openings 43*a* are all closed at the top surface of the spacer and the air flow through spacer openings 43*a* will be blocked.

Figure 4D:
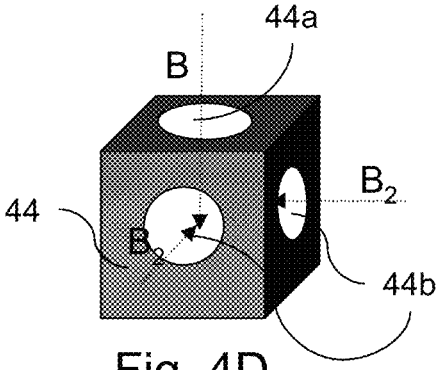

FIG. 4D shows a spacer 44, which has rectangular form, having a circular spacer opening 44*a* being open at the top of the spacer 44 and four circular spacer openings 44*b* at the four sides of the spacers. The spacer opening 44*a* and the four spacer openings 44*b* are operatively coupled to an air flow source. Air may flow through the spacer openings 44*a* and 44*b* in direction of arrow B and $B_2$ respectively or in opposite direction. In case the spacer 44 is supported on a flat surface, the spacer opening 44*a* is closed at the top surface of the spacer and the air flow through spacer opening 44*a* will be blocked. However at the same time the four circular spacer openings 44*b* are not closed and the air will still flow at the four sides of the spacers.

Figure 4E:
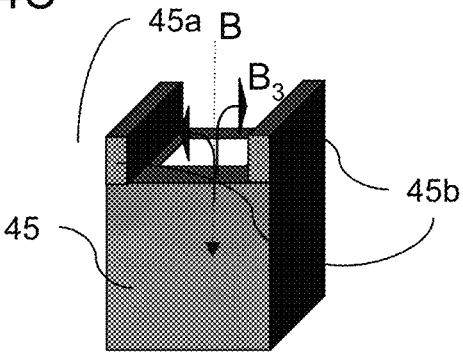

FIG. 4E shows a spacer 45, which has rectangular form, having a square spacer opening 45*a* being open at the top of the spacer 45, and having two bars 45*b* at both sides of the square spacer opening 45*a*. Air may flow through the spacer opening 45*a* in direction of arrow B or in opposite direction. In case the two bars 45*b* of the spacer 45 is supported on a flat surface, the spacer opening 45*a* is not closed at the top surface of the spacer and the air flowing out or in through spacer opening 45*a* will be diverged in a direction $B_3$ parallel to the flat surface and perpendicular to the bars 45*b*.

The above described forms of the spacer (41-45) are given by example only. As a person skilled in the art will immediately contemplate, other forms having the same function may be used instead.

Figure 5:
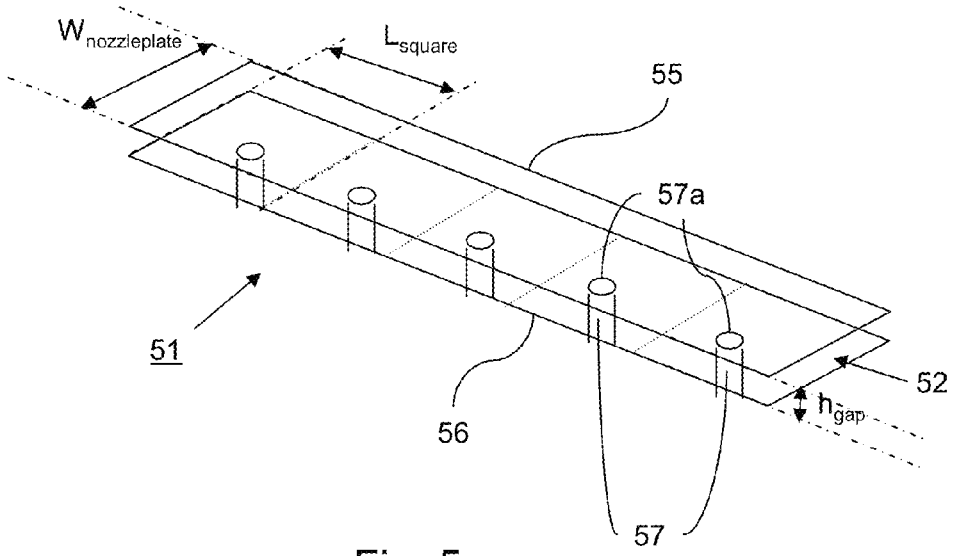
FIG. 5 shows a suction surface of a suction device according to an embodiment of the invention.

FIG. 5 shows a suction surface 56 of a suction device 51 according to an embodiment of the invention. The suction surface 56 comprises a plurality of suction openings 57*a* each operatively coupled to suction channel 57, which are arranged perpendicular to the suction surface 56. The suction channels 57 are arranged in a row. The width and length of the suction surface 56 is substantially equal to the width and length of the nozzle surface 55. The distance $I_{square}$ between the suction channels 57 is made equal to the width $W_{nozzle\ surface}$ of the nozzle surface 55. The suction gap 52 has a height $h_{gap}$ between the nozzle surface 55 and the suction surface 56 and is divided in small squares. In each square one suction channel will provide the air flow through the suction gap along the nozzle surface and into the suction channel by providing a suction pressure in the square of the suction gap. This arrangement provides an equal restriction from each suction channel towards the environment (e.g. sides of the suction gap) and thereby makes sure that the surface is equally cleaned. The suction gap 52 is the highest restriction in the chain between suction gap and the air flow suction unit. As a result a suitable high air velocity is reached in the suction gap.

Figure 6:
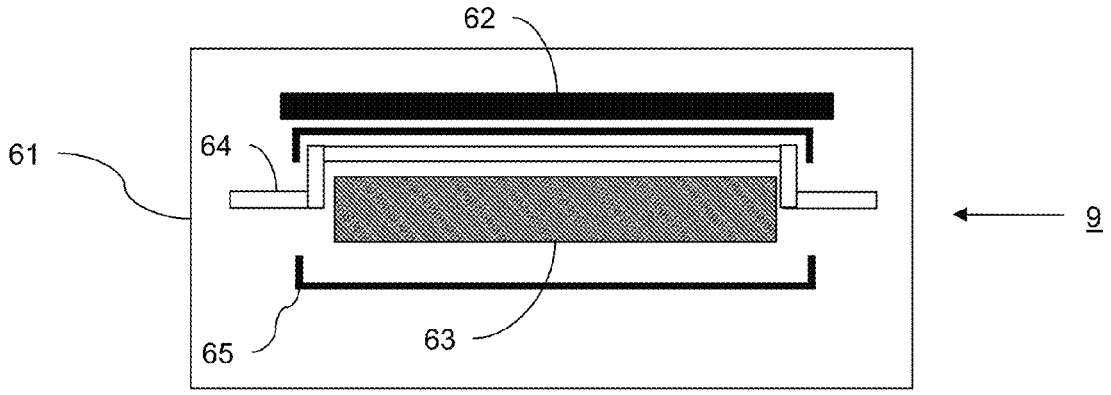
FIG. 6 shows the flexure element when seen from above in z-direction in FIG. 2A.

FIG. 6 shows the flexure element 9 when is seen from above in z-direction in FIG. 2A. The flexure element 9 comprises a sheet material 61, for example metal, which comprises several cuts 65.

Further in the cross-section the area of the suction surface 63 is indicated. The flexure element further comprises a spit gap 62 for catching ink droplets, which are ejected from the nozzle during a maintenance procedure. A switch between a nozzle surface cleaning mode and a spit-mode can be made during a maintenance procedure by moving the carriage and thereby relocating the nozzle surface above the suction surface 63 and spit gap 62.

The flexure element 9 further comprises an integrated channel structure 64, created by laminated sheets of a sheet material, for example metal, with different patterns. The integrated channel structure 64 connects a plurality of individual suction devices provided for each print head in the inkjet printer system to a common air flow suction unit (not shown).

Figure 7:
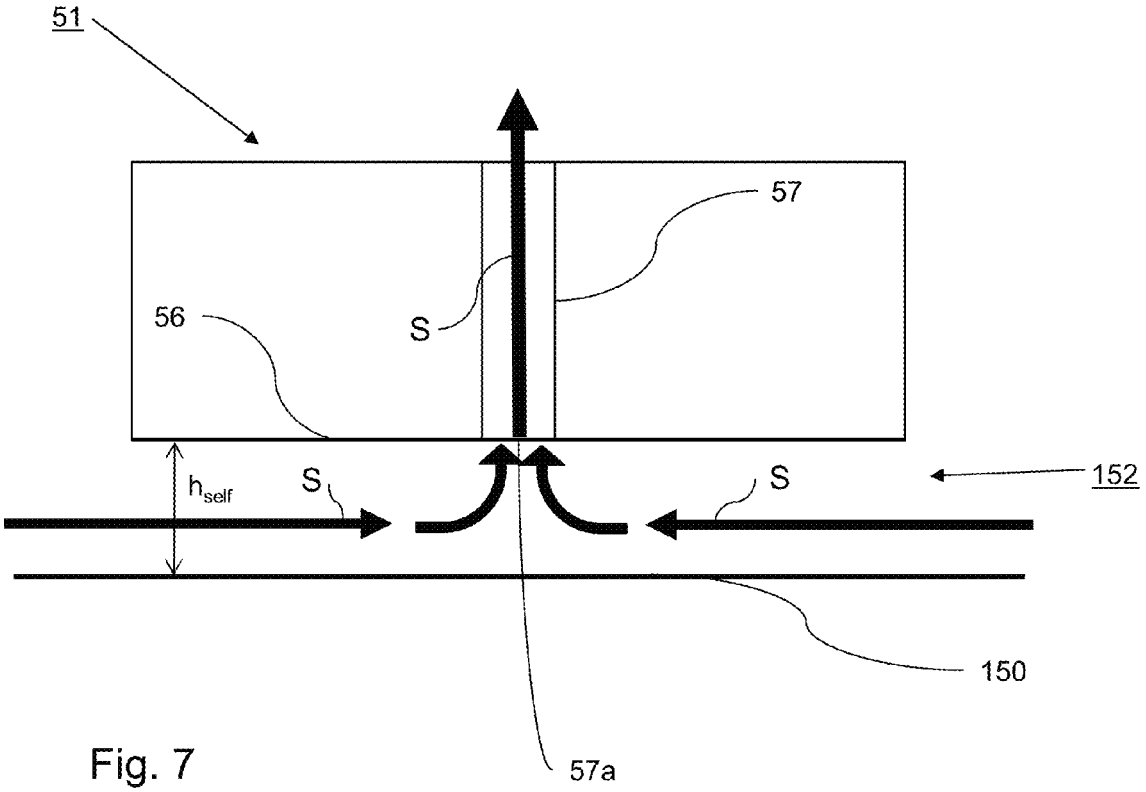
FIG. 7 shows a self cleaning process of a suction surface of the suction device.

FIG. 7 shows a self cleaning process of a suction surface of the suction device. In FIG. 7 a cross section of the suction device 51 is shown in a width direction perpendicular to the extending direction of the row of suction channels 57. The suction surface 56 of the suction device 51 is arranged opposing a self cleaning surface 150. The self cleaning surface is selected larger in area than the suction surface. A distance $h_{self}$ between the suction surface 56 and the self cleaning surface 150 is suitably selected in order to provide a self-cleaning gap 152. The distance $h_{self}$ is provided by arranging the spacer of the suction device 51 opposing the self cleaning surface 150. In case the spacer protrudes from the suction surface, the outer surface of the spacer is supported on the self cleaning surface 150 (not shown).

An air flow is provided through the self cleaning gap 152, through the suction opening 57*a* in the suction channel 57 (as indicated by arrows S). The air flow S is provided by sucking air through the suction channel by use of the air flow suction unit 211 (shown in FIG. 2A). The air flow S removes any remaining contamination and ink from the suction surface 56, which may be left behind on the suction surface 56 after the use of the suction device 51 while cleaning a nozzle surface. The air flow S may be suitably selected and may be higher than an air flow during cleaning operation of the suction device in case of cleaning a nozzle surface.

Detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any combination of such claims is herewith disclosed. Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention claimed is:

1. A suction device for cleaning a nozzle surface of a print head, the suction device comprising:

a) a suction surface, which comprises a suction opening operatively coupled to a suction channel, b) a spacer, wherein the spacer is configured for positioning the suction surface at a predetermined distance from the nozzle surface for providing a suction gap, wherein the spacer is provided with a spacer channel, the spacer channel comprising a spacer opening at an outer surface of the spacer and the spacer channel being operatively coupled to an air flow source, and c) an air flow suction unit, the air flow suction unit being operatively coupled to the suction channel, wherein the spacer is formed at a side of the suction gap, and the side of the suction gap is open to allow an air flow into the suction gap, along the nozzle surface and into the suction channel.

2. The suction device according to claim 1, wherein the air flow along the nozzle surface is directed in a direction substantially parallel to the nozzle surface.

3. An inkjet printer comprising the suction device of claim 2.

4. The suction device according to claim 1, wherein the spacer protrudes with respect to the suction surface and the suction device is configured to support the nozzle surface by the outer surface of the spacer.

5. The suction device according to claim 4, wherein the spacer opening of the spacer channel of the spacer is arranged to be closed upon supporting of the spacer on the surface of the nozzle surface.

6. An inkjet printer comprising the suction device of claim 5.

7. An inkjet printer comprising the suction device of claim 4.

8. The suction device according to claim 1, wherein the spacer comprises an air bearing means, wherein the air bearing means is configured for in operation blowing an air flow through the spacer channel and the spacer opening towards the nozzle surface thereby positioning the suction surface at the predetermined distance from the nozzle surface.

9. The suction device according to claim 1, wherein the air flow source being coupled to the spacer channel is the air flow suction unit, which is operatively coupled to the suction channel.

10. The suction device according to claim 1, wherein the suction device comprises a plurality of suction channels being arranged in a row.

11. The suction device according to claim 10, wherein the row of suction channels has a length substantially equal to a length of a row of nozzles of the nozzle surface.

12. The suction device according to claim 10, wherein the plurality of suction channels is arranged such that the air flow along the nozzle surface is substantially equal in velocity throughout the suction gap.

13. The suction device according to claim 10, wherein the suction device comprises a first spacer being positioned adjacent to a first end of the row of suction channels and a second spacer being positioned adjacent to a second end of the row of suction channels and wherein the spacer opening of each spacer is configured to be arranged opposite to the nozzle surface in an area outside of a nozzle area.

14. The suction device according to claim 10, wherein the plurality of suction channels is arranged at a distance between each other being substantially equal to a width of the nozzle surface.

15. An inkjet printer comprising the suction device of claim 1.

16. A method for cleaning a nozzle surface of a print head, the nozzle surface comprising a plurality of nozzles by using a suction device, the suction device comprising a suction surface, which comprises a suction opening operatively coupled to a suction channel, a spacer, wherein the spacer is configured for positioning the suction surface at a predetermined distance from the nozzle surface, wherein the spacer is provided with a spacer channel, the spacer channel comprising a spacer opening at an outer surface of the spacer and the spacer channel being operatively coupled to an air flow source, and an air flow suction unit, the air flow suction unit being operatively coupled to the suction channel, the method comprising the steps of:

a) positioning the spacer near the nozzle surface and away from a nozzle;

b) providing an air flow through the spacer channel of the spacer;

c) the spacer positioning the suction surface at the predetermined distance from the nozzle surface, thereby providing a suction gap, the spacer formed at a side of the suction gap; and d) providing an opening in the side of the suction gap to allow an air flow into the suction gap, along the nozzle surface and into the suction channel in order to clean the nozzle surface.

17. The method according to claim 16, wherein the spacer protrudes with respect to the suction surface and wherein step c) comprises supporting the outer surface of the spacer on the surface of the nozzle surface in order to position the suction surface at the predetermined distance from the nozzle surface.

18. The method according to claim 17, wherein step b) comprises cleaning an area of the nozzle surface using the air flow, and wherein in step c) the spacer is supported in the area of the nozzle surface, which is cleaned during step b).

19. The method according to claim 17, wherein step c) comprises closing the spacer opening of the spacer channel of the supported spacer by the nozzle surface.

20. The method according to claim 16, wherein step c) comprises blowing air through the spacer channel of the spacer in order to arrange the suction surface at the predetermined distance from the nozzle surface.

* * * * *